US006286709B1

(12) United States Patent
Hudson

(10) Patent No.: US 6,286,709 B1
(45) Date of Patent: Sep. 11, 2001

(54) INSULATING SLEEVE

(76) Inventor: Cathy Hudson, P.O. Box 253, Tieton, WA (US) 98947

( * ) Notice: Subject to any disclaimer, the term of this patent is extended or adjusted under 35 U.S.C. 154(b) by 0 days.

(21) Appl. No.: 09/289,278

(22) Filed: Apr. 9, 1999

(51) Int. Cl.[7] ..... B65D 65/00

(52) U.S. Cl. ..... 220/739; 220/903; 229/403

(58) Field of Search ..... 220/737, 738, 220/739, 592.16, 592.17, 592.2, 592.24, 592.26, 903; 215/12.1, 13.1, 395; 224/148.3, 148.4, 148.6, 148.7, 219–221; 229/402, 403; 2/247, 243.1

(56) References Cited

U.S. PATENT DOCUMENTS

| | | | | |
|---|---|---|---|---|
| D. 286,606 | | 11/1986 | Curtis et al. . | |
| D. 302,636 | | 8/1989 | Singer . | |
| D. 399,707 | | 10/1998 | Villarreal, Jr. . | |
| 4,282,279 | | 8/1981 | Strickland . | |
| 4,293,015 | | 10/1981 | McGough . | |
| 4,351,872 | * | 9/1982 | Brosseau et al. | 428/198 |
| 4,372,453 | | 2/1983 | Branscum . | |
| 4,401,245 | * | 8/1983 | Zills | 220/903 |
| 4,462,444 | | 7/1984 | Larson . | |
| 4,534,391 | | 8/1985 | Ventimiglia et al. . | |
| 4,540,611 | * | 9/1985 | Henderson | 220/739 |
| 4,671,424 | | 6/1987 | Byrns . | |
| 4,698,854 | * | 10/1987 | Slimmon | 2/247 X |
| 4,708,254 | | 11/1987 | Byrns . | |
| 4,843,653 | * | 7/1989 | Coble | 2/59 X |
| 4,886,183 | | 12/1989 | Fleming . | |
| 4,918,758 | * | 4/1990 | Redina | 2/171 |
| 4,961,235 | * | 10/1990 | Williger | 2/239 |
| 5,102,036 | | 4/1992 | Orr et al. . | |
| 5,146,630 | * | 9/1992 | Richard | 2/247 X |
| 5,163,608 | | 11/1992 | Block . | |
| 5,222,656 | | 6/1993 | Carlson . | |
| 5,251,460 | | 10/1993 | DeMarco . | |
| 5,305,470 | * | 4/1994 | McKay | 2/7 |
| 5,415,305 | | 5/1995 | Drake-Tipton et al. . | |
| 5,429,265 | * | 7/1995 | Maire et al. | 220/735 |
| 5,555,566 | * | 9/1996 | Kuhn | 2/247 |
| 5,651,142 | * | 7/1997 | Del Valle Mas | 2/247 |
| 5,704,067 | * | 1/1998 | Brady | 224/219 X |
| 5,708,979 | * | 1/1998 | Redwood et al. | 2/161.1 |
| 5,756,180 | * | 5/1998 | Squires et al. | 428/90 |
| 5,765,712 | | 6/1998 | Skinner et al. . | |
| 5,772,066 | * | 6/1998 | Reynolds | 220/735 |
| 5,784,721 | * | 7/1998 | Huff | 2/239 |
| 5,797,528 | * | 8/1998 | McDuffie | 224/610 |
| 5,845,413 | * | 12/1998 | Zayat, Jr. | 33/760 |
| 5,845,804 | | 12/1998 | Prescott . | |
| 5,857,615 | | 1/1999 | Rose . | |
| 5,971,200 | * | 10/1999 | Reynolds | 220/735 |
| 6,019,245 | * | 2/2000 | Foster et al. | 220/739 |

FOREIGN PATENT DOCUMENTS

| | | | | |
|---|---|---|---|---|
| 3023668 | * | 1/1982 | (DE) | 224/219 |

OTHER PUBLICATIONS

Brystie, Inc. Brochure for Turtle Fur, Dec. 1992.*
Photocopy of Java Jacket® cup sleeve.

* cited by examiner

*Primary Examiner*—Allan N. Shoap
*Assistant Examiner*—Joe Merek
(74) *Attorney, Agent, or Firm*—Stratton Ballew PLLC

(57) ABSTRACT

An insulating sleeve for a beverage container is provided. The sleeve is constructed from at least two layers of fabric, and has an integral pocket incorporated between the two layers. Two elasticized fleece fabric panels, each having a rectangular body area and a pocket extension, are joined at their edges and then attached at their ends to form the sleeve. The pocket extensions are folded down between the two elasticized fleece fabric panels to form the integral pocket. The insulating sleeve has indicia affixed to its outer surface. The sleeve provides a beverage cup insulating sleeve that is easily positionable on a beverage cup, and that will remain in position without adjustment. It can be machine washed and used repeatedly, instead of thrown away after use. The sleeve can adapt itself to fit a variety of container shapes, and can be folded compactly for storage when not in use. Additionally the pocket provides a way of keeping a punch-card with the sleeve.

6 Claims, 7 Drawing Sheets

INSULATING SLEEVE

TECHNICAL FIELD

This invention relates to the field of insulating devices for beverage containers. More specifically, the invention relates to a fabric insulating sleeve for a beverage container, and a method for manufacturing the insulating sleeve.

BACKGROUND OF THE INVENTION

A common problem experienced by purchasers of hot beverages such as coffee and espresso is that the disposable cup in which the beverage is served is often too hot to hold comfortably. To address this problem, various solutions have been attempted. The simplest and most obvious solution has been to wrap one or more paper napkins around the cup to avoid burns or discomfort to the hand. However, this primitive solution is inadequate. Although the napkins will insulate the beverage cup while the cup is being held, they will not stay in place if the cup is put down. It is necessary to reposition the napkins each time the cup is picked up, which can result in accidental burns and spillage. It would therefore be desirable to have a beverage cup insulating sleeve that is comfortable to hold and easily positionable on a beverage cup, and that will remain in position without adjustment.

In response to the recognized need for a better beverage insulator, various types of disposable cardboard and paper sleeves have been used with some degree of success. The sleeves are sized to slide onto the outside of a beverage cup, and are held in place by friction. The upwardly widening diameter of the typical beverage cup prevents the sleeve from sliding off the cup while the cup is being held. However, while cardboard and paper sleeves are minimally functional as beverage cup insulation devices, they are generally only used once, and then discarded. Because the unnecessary use of paper products is environmentally unwise, especially with insulating materials like foam or plastic that are not bio-degradeable and considered environmentally unfriendly when discarded. It would therefore be desirable to have an insulating sleeve that is not disposable, but instead can be used repeatedly. Relatedly, it would be desirable to have an insulating sleeve that is more esthetically pleasing and pleasing to the touch as compared to paper or cardboard.

Cold beverages also require insulation, in that holding a cold beverage is uncomfortable and quickly warms the beverage. There are various types of reusable beverage container insulating devices made especially for cold beverages, many of which are fabricated from molded or pliable foam products. These devices are generally bulky, and impractical for storing in a purse or pocket when not in use. An additional drawback of these devices is that they are usually fitted to a specific size of beverage container, such as a twelve-ounce beverage can, and cannot be used with other sizes or shapes of containers. It would therefore be desirable to have an insulating sleeve, which can adapt itself to fit a variety of container shapes, and can be folded compactly for storage when not in use.

It is a common practice among beverage vendors to provide a "punch card" to their customers. The punch card is presented to the vendor for validation at the time a beverage is purchased. When the customer has obtained a predetermined number of validations, he is entitled to a premium, such as a free beverage. Alternatively, a customer may prepurchase a quantity of beverages for convenience. The vendor then gives the customer a punch card, which verifies the prepurchased beverages, and can be redeemed anytime. No matter how the punch card is used, it represents monetary value and it is used every time a beverage is purchased. Having a way of keeping a punchcard and an insulating device together would therefore be desirable.

SUMMARY OF THE INVENTION

The present invention meets the above described needs and others by providing an insulating sleeve for beverage containers. The sleeve is constructed from at least two layers of fabric, and has an integral pocket incorporated between the two layers.

According to an aspect of the invention, two elasticized fleece fabric panels, each having a rectangular body area and a pocket extension, are joined at their edges and then attached at their ends to form a sleeve. The pocket extensions are folded down between the two elasticized fleece fabric panels to form the integral pocket.

According to a further embodiment of the invention, the insulating sleeve has indicia affixed to its outer surface.

An advantage of the present invention is that it provides a beverage cup insulating sleeve that is easily positionable on a beverage cup, and that will remain in position without adjustment.

An additional advantage of the present invention is that it provides an insulating sleeve that can be machine washed and used repeatedly, instead of thrown away after use.

A further advantage of the present invention is that it provides an insulating sleeve made of a fabric, which is pleasing to the touch and has insulating properties.

Yet a further advantage of the present invention is that it provides an insulating sleeve, which can adapt itself to fit a variety of container shapes, and can be folded compactly for storage when not in use.

An additional advantage of the present invention is that it provides a way of keeping a punch card and an insulating device together.

These and other advantages will become evident in the description and drawings, which follow.

DETAILED DESCRIPTION OF SPECIFIC EMBODIMENTS

Figure 1:
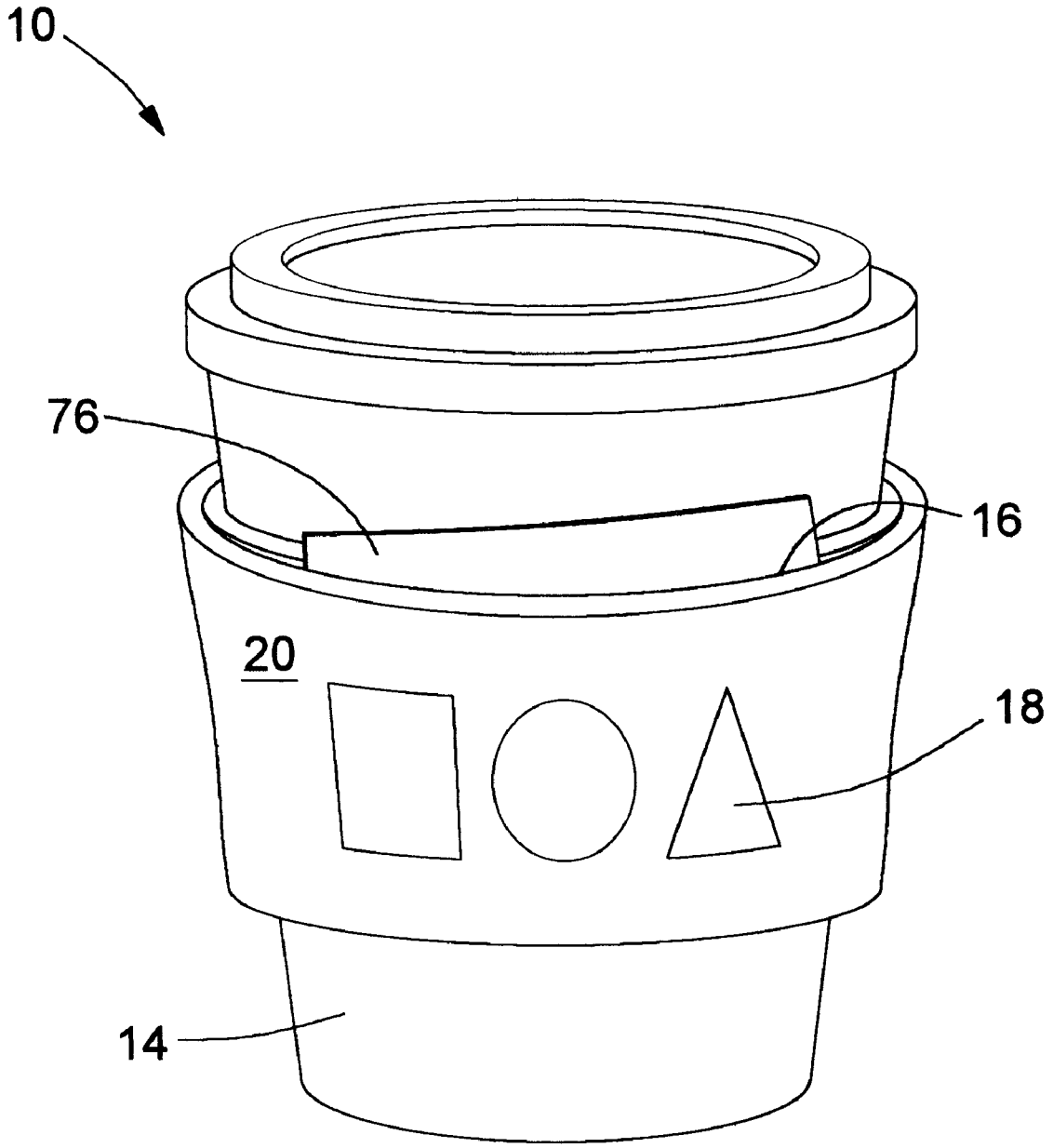
FIG. 1 is a perspective view of an embodiment of the insulating sleeve of the present invention in use on a beverage container.
Figure 2A:
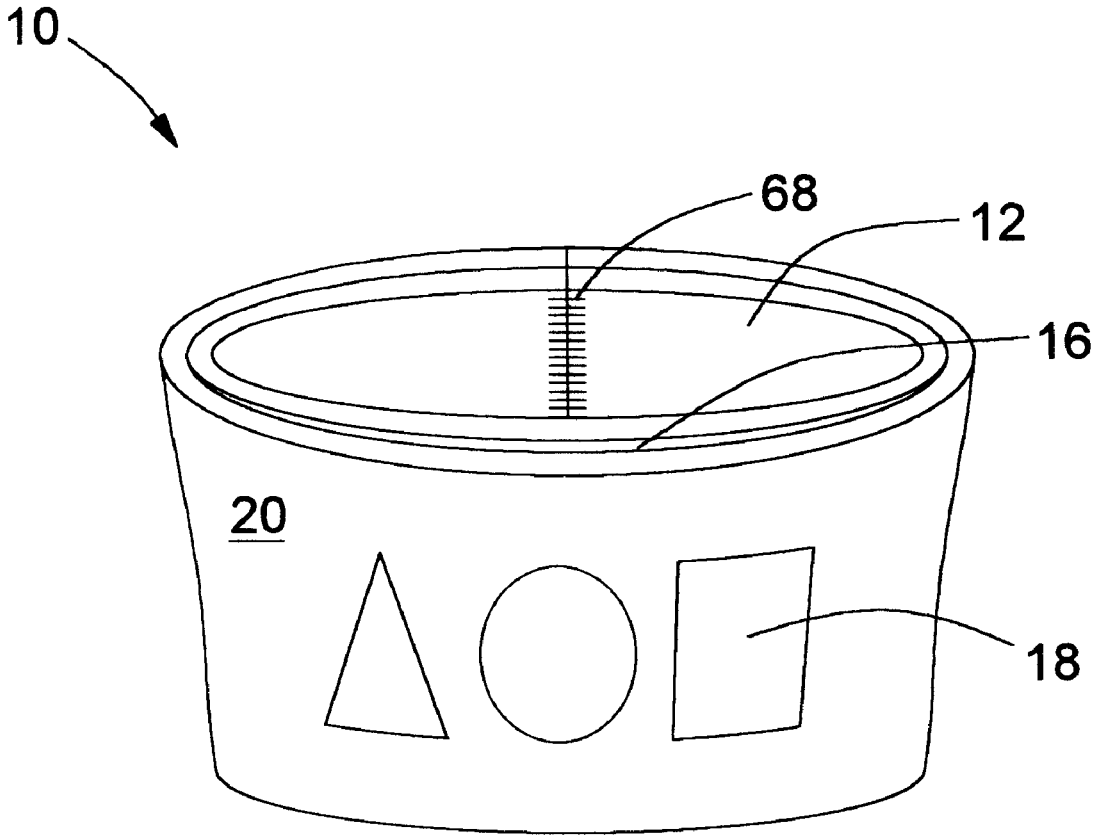
FIG. 2A is a perspective view of an embodiment of the insulating sleeve of the present invention.
Figure 2B:
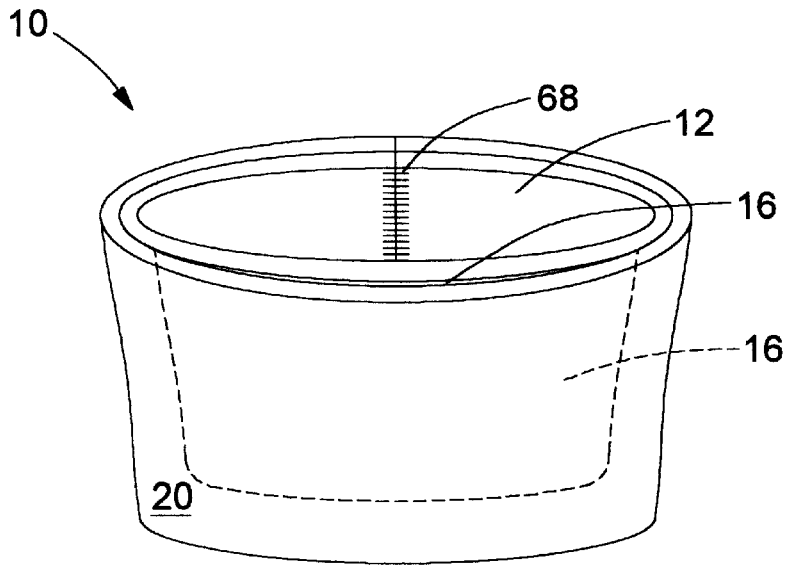
FIG. 2B is a perspective view of an embodiment of the insulating sleeve of the present invention, with the pocket shown in outline.
Figure 3:
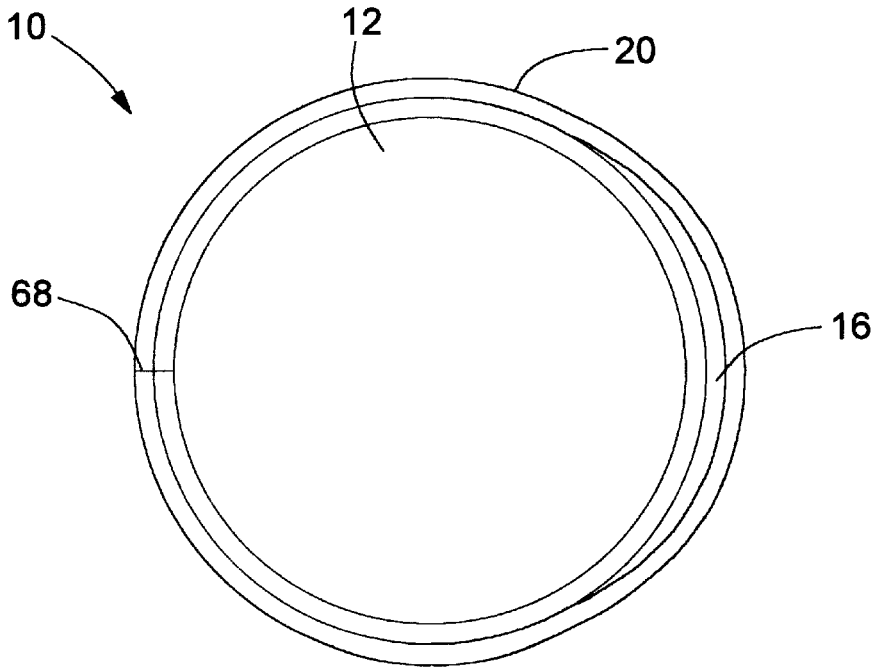
FIG. 3 is a top view of an embodiment of the insulating sleeve of the present invention.

The insulating sleeve 10 of the present invention is shown generally in FIGS. 1 through 5C. The insulating sleeve has a sleeve interior 12 sized to receive a container 14, such as a beverage cup as shown in FIG. 1. Additionally, the insulating sleeve has an integral pocket 16. In a preferred embodiment, the insulating sleeve bears indicia 18 on its exterior surface 20. For the purposes of this application, the term indicia can correspond to a logo, advertizement or printed image and can include any number of or variety of text, colored and reflective elements.

The insulating sleeve 10 is preferably constructed from an elasticized fabric to hold containers 14 of varying sizes. The inventor has had success using one-way stretch fleece fabric. The fabric is machine washable and dries quickly. Because of the durability of the selected fabric, the insulating sleeve can be reused many times and is environmentally friendly, minimizing impact to landfills.

Figure 4A:
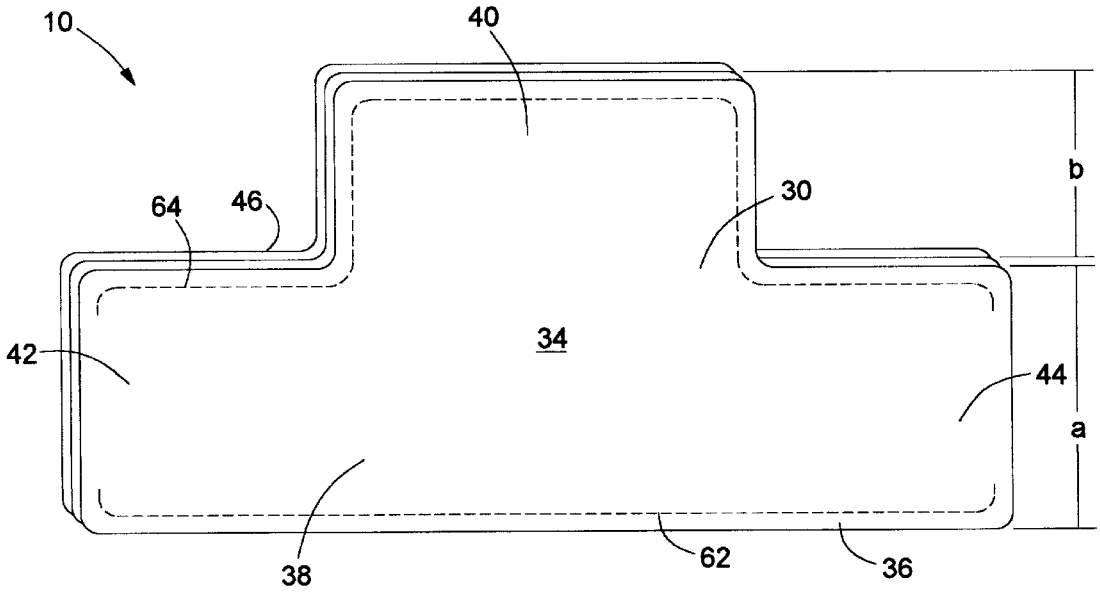
FIG. 4A is a perspective view of an embodiment of the partially assembled insulating sleeve.

FIGS. 4A, 4B, 4C, 5A, 5B and 5C illustrate the construction of a preferred embodiment of the invention. The insulating sleeve 10 has at least a first layer and a second layer. In a preferred embodiment, the first layer is a first panel 30 and the second layer is a second panel 46. The first panel has a first outer surface 32 and a first inner surface 34. The first panel is shaped substantially like an inverted "T" and has an edge 36, as illustrated in FIG. 4A. The "T" includes a first substantially rectangular body area 38 and first panel pocket extension 40, which extends perpendicularly from the first substantially rectangular body area. The first panel further has a first panel first end 42 and a first panel second end 44.

Figure 4B:
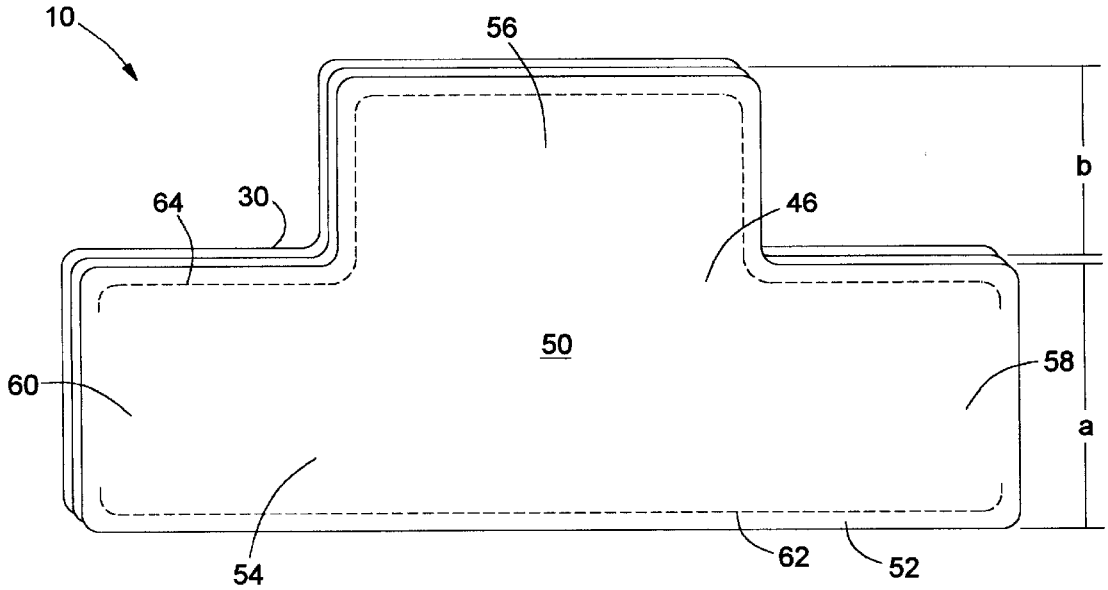
FIG. 4B is a perspective view of a portion of an embodiment of the insulating sleeve.

The second panel 46 is shown in FIG. 4B and is substantially identical to the first panel 30 shown in FIG. 4A. The second panel has a second outer surface 48 (see FIG. 5A) and a second inner surface 50. Like the first panel, the second panel is shaped substantially like an inverted "T" and has an edge 52. The "T" is defined by a second substantially rectangular body area 54 and a second panel pocket extension 56, which extends perpendicularly from the second substantially rectangular body area. The second panel further has a second panel first end 58 and a second panel second end 60.

The first substantially rectangular body area 30 and the second substantially rectangular body area 46 have a width a. The first panel pocket extension 40 and the second panel pocket extension 56 have a width b that is less than width a.

In the preferred embodiment illustrated herein, the first panel pocket extension 40, the second panel pocket extension 56, and the pocket 16 are substantially rectangular in shape, to accommodate a thin rectangular object. However, other pocket shapes (not shown) are contemplated.

As shown in FIGS. 4A and 4B, the first panel 30 and the second panel 46 are joined in alignment with one another along edges 36 and 52, with the first outer surface 32 and the second outer surface 48 facing each other, and the first inner surface 34 and the second inner surface 50 facing outward. In a preferred embodiment, the first panel and the second panel are joined by stitching 62 and 64.

While the first layer and the second layer are described herein as the first panel 30 and the second panel 46, It is contemplated that the first layer and the second layer could be formed from a single folded piece of fabric.

Figure 4C:
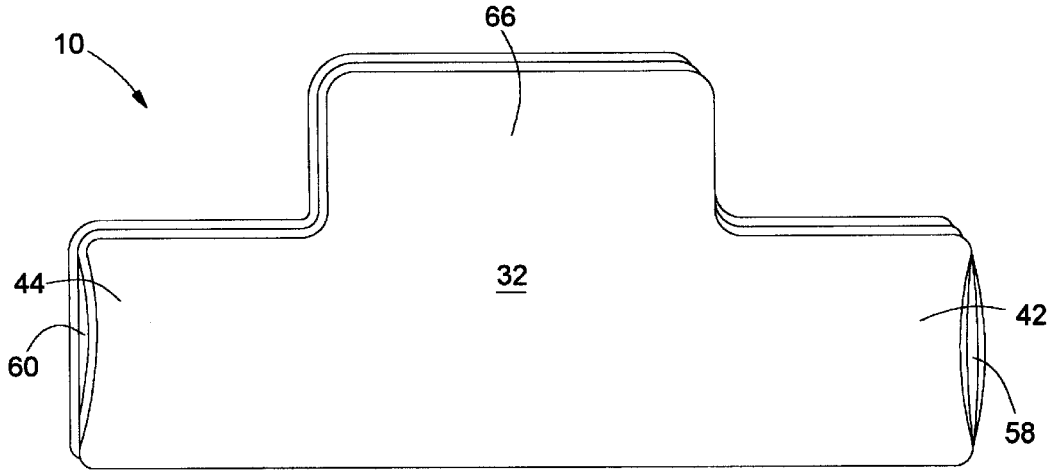
FIG. 4C is a perspective view of an embodiment of the partially assembled insulating sleeve.

FIG. 4C illustrates the insulating sleeve 10 of the present invention after the embodiment shown in FIGS. 4A and 4B have been inverted so that the first inner surface 34 and the second inner surface 50 are facing each other, and the first outer surface 32 and the second outer surface 48 are facing outward. The first pocket extension 40 and the second pocket extension 56 now form inverted pocket 66.

Figure 5A:
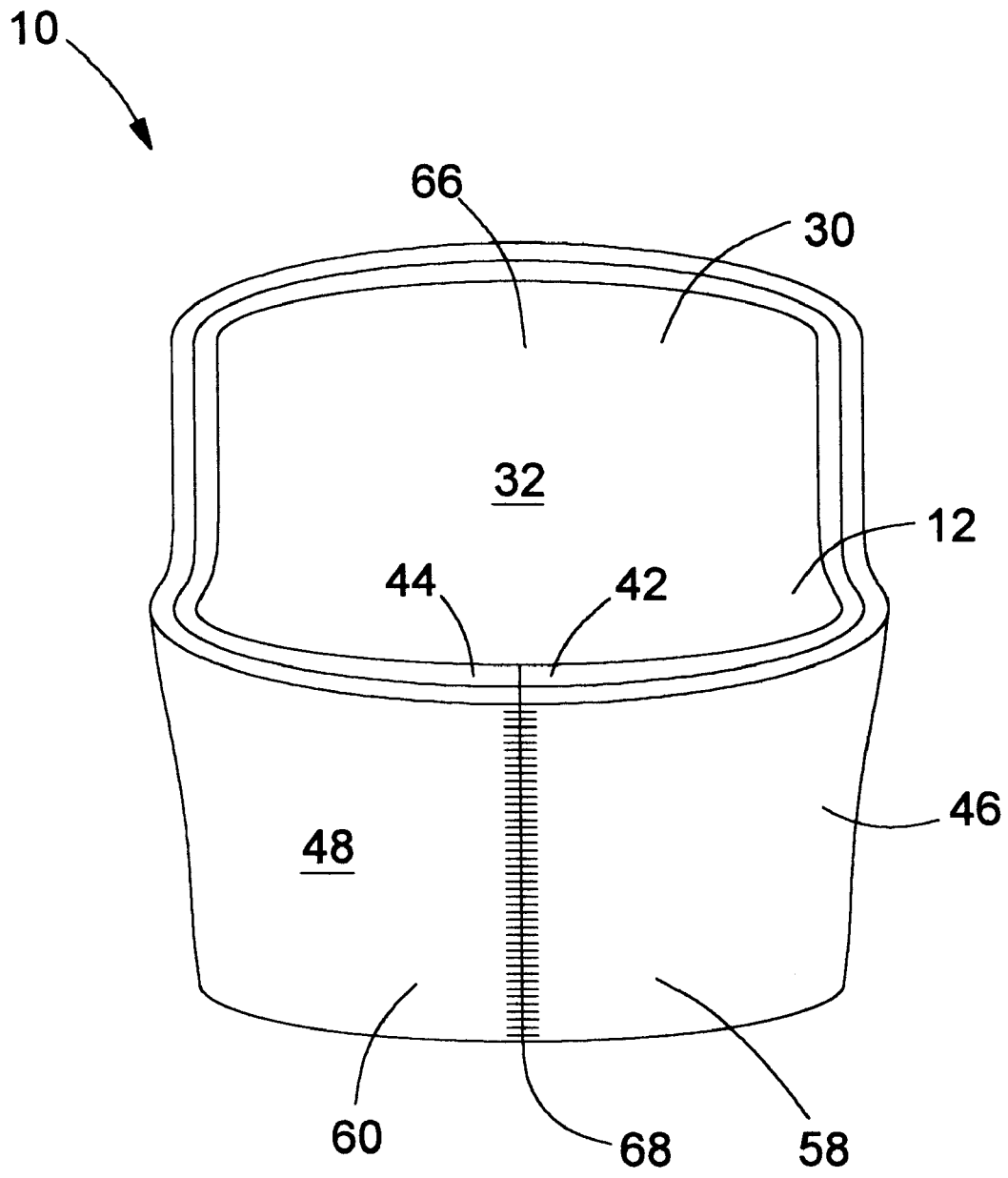
FIG. 5A is a perspective view of an embodiment of the insulating sleeve of the present invention with the inverted pocket protruding.
Figure 5B:
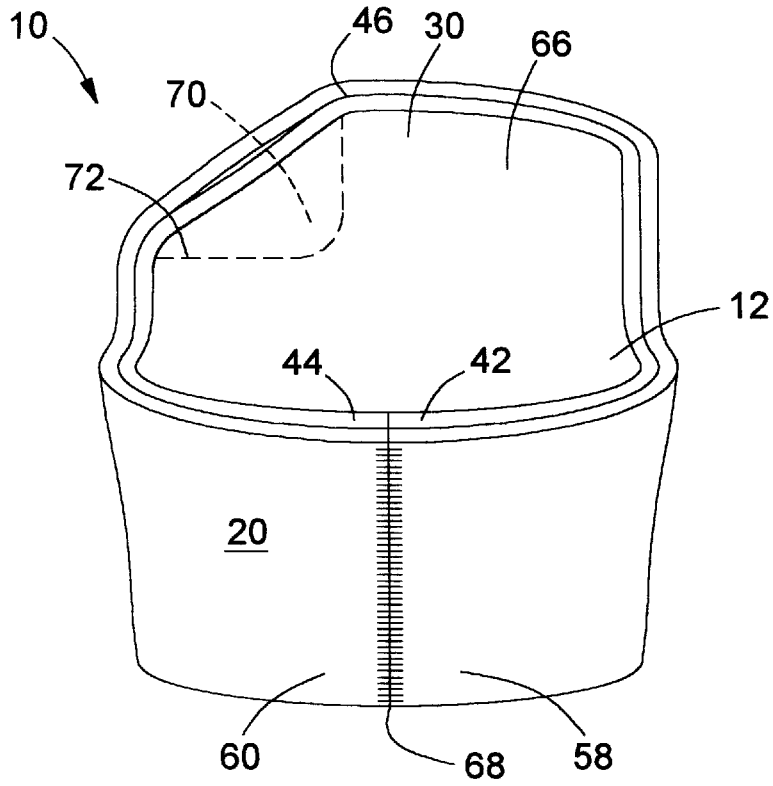
FIG. 5B is a perspective view of an embodiment of the insulating sleeve of the present invention with the inverted pocket partially pushed inside.
Figure 5C:
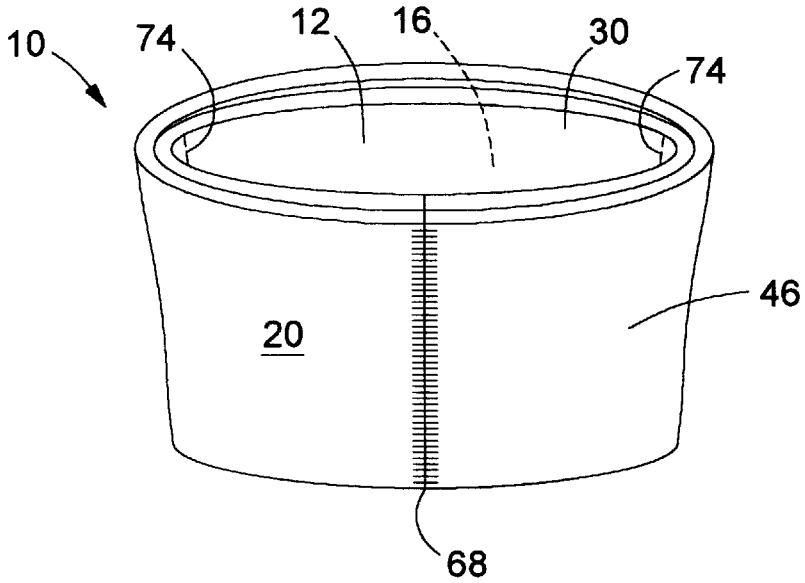
FIG. 5C is a perspective view of an embodiment of the insulating sleeve of the present invention with the pocket extension pushed inside.

FIG. 5A illustrates the insulating sleeve 10 of the present invention with the ends 44 and 60 joined to ends 42 and 58. In the preferred embodiment illustrated here, the ends are joined by stitching 68. In FIG. 5B, a corner 70 of the inverted pocket 66 is pushed between the first panel 30 and the second panel 46 as indicated by broken lines 72, so that the first outer surface 32 and the second outer surface 48 in the corner are facing each other. FIG. 5C illustrates the insulating sleeve in its functional form, with the inverted pocket completely pushed in to form the pocket 16. In the pocket, the first outer surface 32 and the second outer surface 48 are facing each other. The outline of the pocket, which is inside the insulating sleeve positioned between the first panel 30 and the second panel 46 is indicated by broken lines 74.

In an alternative preferred embodiment of the invention, either the first outer surface 32 or the second outer surface 48, or both the first outer surface and the second outer surface, bear indicia 18 for advertising, identification, novelty or other purposes.

In a preferred method of manufacturing the insulating sleeve 10 of the present invention, a fabric is selected. Preferably, an elastic fabric is selected. Most preferably, a one-way stretch fleece fabric is selected. Next, a first panel 30 and a second panel 46 are cut from the fabric, most preferably in the shape illustrated in FIGS. 4A and 4B. Alternatively, the fabric is cut to a different shape (not shown) which will lend itself to achieving the construction described above. For example, the pocket extensions 40 and 56 may be rounded or triangular in shape. As a further example, the edges 36 and 52 may be cut with a wave or other decorative pattern. Also, alternatively, the first panel and the second panel may be embodied in a single cut of fabric.

The first panel 30 and the second panel 46 are then stitched together, along stitching lines 62 and 64 as illustrated in FIGS. 4A and 4B, so that the first outer surface 32 and the second outer surface 48 are facing each other. The insulating sleeve 10 is then inverted so that the first outer surface and the second outer surface are facing outward. Next, the ends 44 and 60 are stitched to the ends 42 and 58 to form a sleeve, as shown in FIGS. 1, 2A, 2B, 3, 5A, 5B, and 5C.

Finally, the pocket 16 is formed. The inverted pocket 66 is uninverted by pushing it down between the first panel 30 and the second panel 46.

In an alternative preferred embodiment, the method of manufacturing the insulating sleeve 10 has the additional step of affixing indicia 18 to either the first outer surface 32 or the second outer surface 48, or to both the first and second outer surfaces, of the insulating sleeve.

In a preferred use of the invention, the insulating sleeve 10 is positioned on a container 14 such as a beverage cup, as shown in FIG. 1. The elasticity of the fabric holds the insulating sleeve in place. The insulating sleeve can be used on a range of container sizes, depending on the dimension of the sleeve interior 12, and the elasticity of the fabric selected.

In an alternative preferred embodiment, the method of the invention has the additional step of inserting an object such as a card 76 (see FIG. 1)in the pocket 16 of the insulating sleeve 10 of the present invention.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited, except by the following claims, as appropriately interpreted in accordance with the doctrine of equivalents.

What is claimed is:

1. An insulating sleeve for beverage containers, the insulating sleeve comprising:

at least a first layer and a second layer of elasticized fabric formed into a sleeve, the sleeve having an exterior surface and a sleeve interior, the sleeve interior for receiving a beverage container; and an integral pocket formed between the first layer and the second layer, the integral pocket for removably receiving an object;

the first layer of elasticized fabric is a substantially t-shaped first panel and the second layer of elasticized fabric is a substantially t-shaped second panel;

the first panel having a first substantially rectangular body area with a first panel first end and a first panel second end, a first panel pocket extension extending perpendicularly from the first substantially rectangular body area, a first outward facing surface, and a first inward facing surface;

the second panel having a second substantially rectangular body area with a second panel first end and a second panel second end, a second panel pocket extension extending perpendicularly from the second substantially rectangular body area, a second outward facing surface, and a second inward facing surface;

the first panel and the second panel joined at their edges such that the first inward facing surface faces the second inward facing surface, the first panel first end aligned with the second panel first end, and the first panel second end aligned with the second panel second end, and the first panel pocket extension aligned with the second panel pocket extension;

the first panel first end and the second panel first end joined to the first panel second end and the second panel second end to form a sleeve; and the first panel pocket extension and the second panel pocket extension positioned between the first substantially rectangular body area and the second substantially rectangular body area to form the integral pocket.

2. The insulating sleeve of claim 1, wherein the elasticized fabric is a one-way stretch fleece.

3. The insulating sleeve of claim 1, further having indicia on the exterior surface of the sleeve.

4. An insulating sleeve for beverage containers, the insulating sleeve comprising:

a substantially t-shaped first panel of elasticized fabric, a substantially t-shaped second panel of elasticized fabric, and an integral pocket formned between the first panel and the second panel, the integral pocket for removably receiving an object;

the first panel including a substantially rectangular first body area with a first panel first end and a first panel second end, a first panel pocket extension extending substantially perpendicularly from the first body area, a first outward facing surface, and a first inward facing surface;

the second panel including a substantially rectangular second body area with a second panel first end and a second panel second end, a second panel pocket extension extending substantially perpendicularly from the second body area, a second outward facing surface, and a second inward facing surface;

the first panel and the second panel joined at their edges such that the first inward facing surface faces the second inward facing surface, the first panel first end aligns with the second panel first end, the first panel second end aligns with the second panel second end, and the first panel pocket extension aligns with the second panel pocket extension;

the first panel first end and the second panel first end joined to the first panel second end and the second panel second end to form a sleeve; and the first panel pocket extension and the second panel pocket extension positioned between the first body area and the second body area to form the integral pocket.

5. The insulating sleeve of claim 4, wherein the elasticized fabric is one-way stretch fleece.

6. The insulating sleeve of claim 4, further having indicia on the exterior surface of the sleeve.

* * * * *